United States Patent [19]

Gruber

[11] 4,198,790

[45] Apr. 22, 1980

[54] METHOD FOR FINISHING SPHERICAL ROLLERS

[75] Inventor: Paul Gruber, Cincinnati, Ohio

[73] Assignee: Cincinnati Milacron Inc., Cincinnati, Ohio

[21] Appl. No.: 2,660

[22] Filed: Jan. 11, 1979

[51] Int. Cl.[2] ..... B24B 1/00; B24B 5/36

[52] U.S. Cl. ..... 51/289 R; 51/81 R

[58] Field of Search ..... 29/148.4 D; 51/81 R, 51/89, 289 R

[56] References Cited

U.S. PATENT DOCUMENTS

| | | | |
|---|---|---|---|
| 1,255,799 | 2/1918 | Schumacher | 51/81 R X |
| 2,069,431 | 2/1937 | Waage | 51/89 |
| 2,507,334 | 5/1950 | Cramer | 51/289 R |
| 2,588,714 | 3/1952 | Feming | 51/81 R |
| 2,982,057 | 5/1961 | Stanhope | 51/289 R X |

*Primary Examiner*—Gary L. Smith

*Attorney, Agent, or Firm*—Thomas M. Farrell

[57] ABSTRACT

A grinding method for grinding spherical rollers is disclosed, wherein the roller has a spherical main diameter and a spherical end form ground thereon, and both spherical forms are ground on the same fixturing set-up. The workpiece is carried on a pair of locating shoes and the pre-ground flat end is driven with a magnetic face driver. A grinding wheel spindle carries first and second wheel forms for forming the roller spherical surfaces, and the surfaces are ground sequentially by feeding the first spherical form radially into the workpiece to grind the diameter, and thereafter axially shifting the wheel spindle to present the second wheel form in position where it is radially fed into the workpiece to grind the spherical end form of the roller.

2 Claims, 4 Drawing Figures

METHOD FOR FINISHING SPHERICAL ROLLERS

BACKGROUND OF THE INVENTION

Spherical rollers, i.e. having a barrel shaped main diameter and a spherical end face for thrusting against the rib of an assembled bearing raceway, are employed in antifriction roller bearing assemblies to permit swiveling of the inner and outer raceways relative to one another, i.e., the rollers are carried by a conventional cage between complimentary forms in the raceways.

As in most roller bearings, the rollers are ground to present the finest possible finishing and sizing attributes to the rollers. Prior art finishing methods include carrying the rough-formed rollers on a first fixturing set up and driving same while grind forming the main diameter in a production operation. Subsequent operations are performed, which include carrying the workpieces to a secondary set up where they are refixtured and journaled on the previously ground diameter and the end spherical form is then finished in a secondary machine and set-up. The problem inherent in the separated finishing operations is that it is difficult to maintain the colinearity of the diametral axis and the radius point of the spherical end form.

SUMMARY OF THE INVENTION

The invention is shown embodied in a grinding machine wherein a common fixturing set-up supports a spherical roller having a plurality of spherical forms to be generated thereon, including a spherical main diameter and a spherical end form. The plurality of spherical forms are shaped into a grinding wheel assembly, wherein the first and second wheel forms are carried on a common grinding wheel spindle which is rotatably carried in a grinding wheelhead. In operation, the grinding wheel assembly is radially fed relatively toward a rotating roller, and the first spherical wheel form is brought into engagement with the roller, grinding the spherical main diameter to a finished size; next, the grinding wheel spindle is axially shifted to such position that the second wheel form may be radially fed relatively toward the workpiece, and radial feed of the grinding wheel spindle causes the second grinding wheel form to finish grind the spherical end diameter of the roller.

DESCRIPTION OF THE PREFERRED EMBODIMENT

Figure 1:
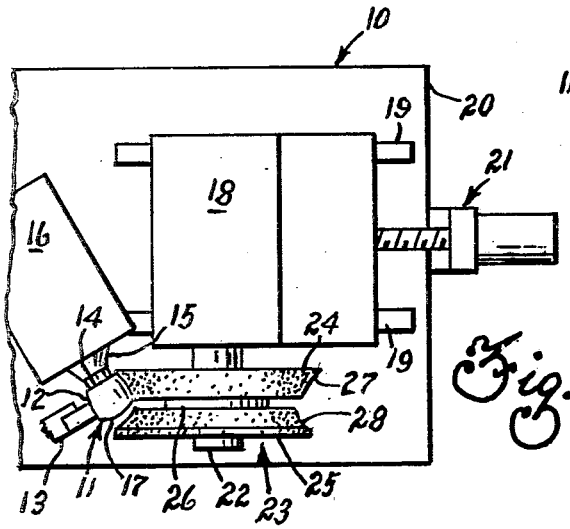
FIG. 1 is a plan view of a grinding machine assembly for finishing spherical rollers.

Referring to FIG. 1, a grinding machine 10 is depicted for finishing spherical rollers 11. The spherical roller 11 is supported on its spherical main diameter 12 on a shoe assembly 13 such as that employed in conventional shoe-type grinding art, and the end face 14 of the roller 11 is supported and driven by the magnetic driver 15 of a grinding headstock 16. The magnetic driver 15 is rotatable in the headstock 16 and imparts the driving force to the roller 11 during the grinding process and acts as a positive locating device. The roller 11 has a spherical main diameter 12 and a spherical end form 17 to be formed. Here it should be noted that in rough processing of the rollers 11, the spherical main diameter 12 is generally formed on the workpiece and the spherical end form 17 may be either rough-formed or merely left flat since it is a gradual convex form in its final size. The preferred processing method contemplated is to rough form the main spherical diameter 12 and grind the end surfaces flat on a double disc grinder. A grinding wheelhead 18 is carried on slideways 19 on the machine base 20, and is fed radially relative to the roller 11, by a feed mechanism suitable for the purpose, such as the motor and screw assembly 21 depicted. The grinding wheelhead 18 has a rotatable grinding wheel spindle 22 carried therewith, and the grinding wheel spindle 22 carries a wheel assembly 23 which is herein depicted as two separate wheels 24,25 separated by a wheel spacer 26, but it may be appreciated that where desired one wheel with several wheel forms dressed therein may be substituted for the two wheel assembly 23 shown.

The grinding wheel assembly 23 has a first inboard spherical concave form 27 dressed into its inboard wheel 24, which corresponds to the convex spherical main diameter 12 of the roller 11. A second concave spherical form 28 is dressed into the outboard wheel 25 of the grinding wheel assembly 23 wherein the concave wheel form 28 corresponds to the spherical end form 17 of the roller 11. As depicted in FIG. 1, when the first wheel form 27 is in contact with the roller 11, the second wheel form 28 is displaced to a position of noncontact with the roller 11. Further, the headstock 16 is swiveled to such position of angularity, that the roller 11 may be contacted on its diameter 12 and end form 17 by the wheels 24,25 when properly fed with the wheelhead 18 in a radial direction.

Figure 2:
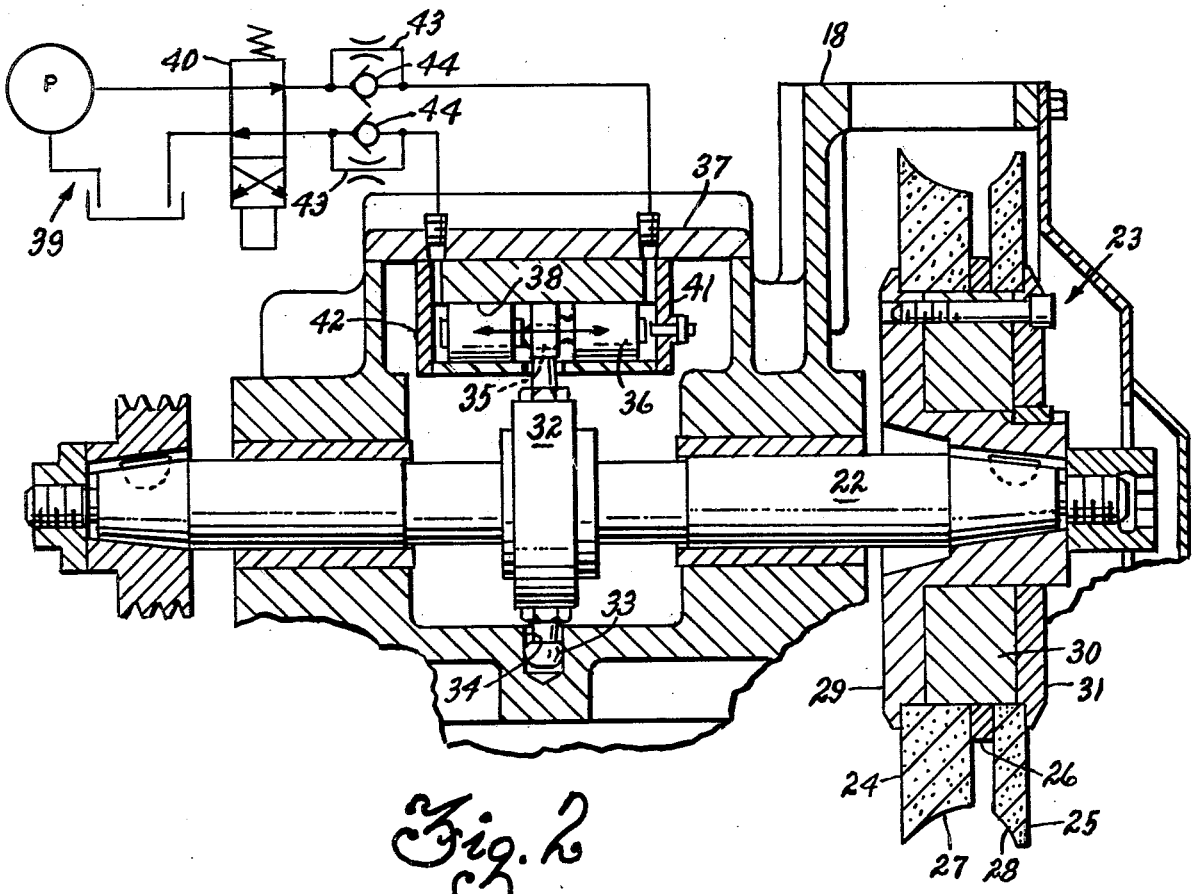
FIG. 2 is an elevational section through a grinding wheel and machine assembly illustrating the mechanism employed in finishing rollers.

The section depicted in FIG. 2 illustrates the rotatable wheel spindle 22 as being journaled in the wheelhead 18 and carrying the grinding wheel assembly 23 thereon. The grinding wheel assembly 23 as shown is comprised of a first wheel 24 having a first concave wheel form 27, carried on a grinding wheel collet 29 which is keyed to the grinding wheel spindle 22. A support ring 30 is adapted to the grinding wheel collet 29 and a grinding wheel spacer 26 is provided on the support ring 30. A second grinding wheel 25 has a second spherical concave form 28 dressed therein, and is carried on the support ring 30 and clamped in an axial direction by a grinding wheel clamp flange 31. The grinding wheel spindle 22 is shiftable in an axial direction by a yoke assembly 32, which has an internal spherical joint journaled with a central grinding spindle flange (not depicted). The yoke assembly 32 has a bottom pivot nob 33 carried in a close-fitting bore 34 in the wheelhead 18 and a top pivot nob 35 is journaled in an axially movable piston 36 carried in a wheelhead cap 37. The wheelhead cap 37 has a cylinder 38 for supporting and pressurizing the ends of the piston 36 at alternate times to move the top yoke nob 35 to alternate positions, which throws the grinding wheel spindle 22 a proportional amount of axial movement corresponding to the piston stroke. Pressure is supplied from a pump and tank assembly 39 through a control valve such as the single solenoid-operated spring return valve 40. The ends 41,42 of the wheelhead cap cylinder 38 are connected through appropriate rate control valves 43 and ball check assemblies 44 and the solenoid operated valve 40 to respective pressure and exhaust lines in a manner well-known in the art. When full pressure is supplied to one end 41 of the cylinder 38, the exhaust from the other end 42 of the cylinder is therefore subjected to a rate control in its exit flow to the tank and, alternately, when the pressure is shifted to the former exhausting end 42, full flow to that end 42 may take place while the exhaust from the former pressurized end 41 is now rate controlled exit to tank. Thus, it can be seen, that through relative ease the two wheel forms 27,28 may be shifted to alternate positions with the grinding wheel spindle 22.

Figure 3:
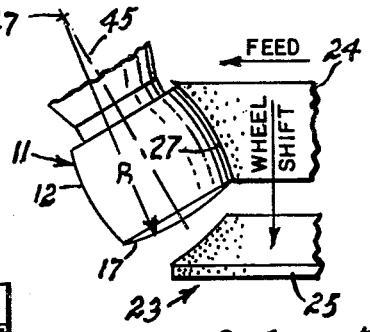
FIG. 3 is a plan view illustrating finish grinding of the spherical main diameter of a spherical roller.
Figure 4:
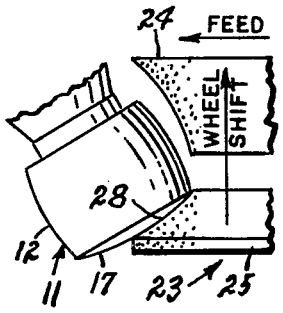
FIG. 4 is a plan view illustrating finish grinding of the spherical end form of a spherical roller.

FIG. 3 depicts the wheel assembly 23 as being axially shifted in the direction of the arrow, and the first wheel form 27 is radially fed into contact with the spherical main diameter 12 of the roller 11, thus grinding the main diameter 12 to the convex form desired. Immediately after completing the main diameter grinding, the wheel assembly 23 is axially shifted in the direction of the arrow of FIG. 4, and radial feed of the second wheel form 28 is commenced so as to finish grind the spherical end form 17 of the rotating roller 11.

By the above-described grinding sequence, the spherical roller 11 may thus be finished to a high degree of precision, both as to finish and size, maintaining the coincidence of the main axis 45 of the spherical diameter 12 and the point 47 of generation of the spherical end form radius, "R".

While not depicted, it may be appreciated that any one of several methods may be employed to dress the spherical forms into the grinding wheels. For example: single point dressing from a profile cam; diamond wheel dressing with preshaped finishing rolls; or preformed wheel shapes may be used which require no dressing.

It is not intended to limit the invention to the specific embodiments shown herein, but rather the invention extends to all such designs and modifications as come within the scope of the appended claims.

What is claimed is:

1. A method of grinding a plurality of spherical forms on a spherical roller, comprising the following steps:

(a) supporting a roller diameter on locating shoes;

(b) driving a first end of said roller with a magnetic driver;

(c) supporting first and second grinding wheel forms on a common rotatable grinding wheel spindle;

(d) radially feeding said first wheel form relatively toward said roller;

(e) grinding a first spherical convex form on said supported diameter while radially feeding said first wheel form;

(f) axially shifting said wheel spindle relative to said roller after grinding said first spherical form;

(g) radially feeding said second form relatively toward said workpiece after axially shifting said wheel spindle; and (h) grinding a second spherical convex form on the second end of said roller while radially feeding said second wheel form.

2. The method of claim 1 further including the step of grinding the ends of said roller substantially flat before supporting said roller diameter on said locating shoes.

* * * * *